US011040806B2

(12) United States Patent
Naumann et al.

(10) Patent No.: US 11,040,806 B2
(45) Date of Patent: Jun. 22, 2021

(54) CLOSURE CAP FOR A CONTAINER

(71) Applicant: HUSKY INJECTION MOLDING SYSTEMS LTD., Bolton (CA)

(72) Inventors: Tobias Naumann, Merzig (DE); Jean-Michel Cunche, Amneville (FR); Jaroslav Habich, Jindrichuv Hradec (CZ)

(73) Assignee: Husky Injection Molding Systems Ltd., Bolton (CA)

( * ) Notice: Subject to any disclaimer, the term of this patent is extended or adjusted under 35 U.S.C. 154(b) by 0 days.

(21) Appl. No.: 16/766,376

(22) PCT Filed: Nov. 19, 2018

(86) PCT No.: PCT/CA2018/051468
§ 371 (c)(1),
(2) Date: May 22, 2020

(87) PCT Pub. No.: WO2019/113681
PCT Pub. Date: Jun. 20, 2019

(65) Prior Publication Data

US 2020/0377268 A1 Dec. 3, 2020

Related U.S. Application Data

(60) Provisional application No. 62/599,140, filed on Dec. 15, 2017.

(51) Int. Cl.
*B65D 41/02* (2006.01)
*B65D 47/08* (2006.01)
(Continued)

(52) U.S. Cl.
CPC ..... *B65D 47/0819* (2013.01); *B65D 41/02* (2013.01); *B65D 43/0235* (2013.01); *B65D 50/00* (2013.01); *B65D 2543/00092* (2013.01)

(58) Field of Classification Search
CPC ..... B65D 47/0819; B65D 41/02; B65D 43/0235; B65D 50/00; B65D 2543/00092
(Continued)

(56) References Cited

U.S. PATENT DOCUMENTS 3,441,161 A 4/1969 Van Baarn
3,696,957 A 10/1972 Van Baarn
(Continued)

FOREIGN PATENT DOCUMENTS

CA 2456525 A1 2/2003
CA 2518870 A1 9/2004
(Continued)

*Primary Examiner* — J. Gregory Pickett
*Assistant Examiner* — Tia Cox

(57) ABSTRACT

The present invention provides a closure cap for a container comprising a lid and a shell, and a hinge region for pivotally connecting the lid to the shell and for locking the lid in an open position thereof. The lid comprises a top panel having a tongue adjacent the hinge region and a cylindrical wall suspended from a bottom face of the top panel and connected to the shell via a plurality of bridges which break upon a first opening of the lid. The hinge region comprises a pair of elongate hinge elements spaced apart from each other, and a ratchet-like member disposed therebetween.

19 Claims, 11 Drawing Sheets

(51) Int. Cl.
*B65D 43/02* (2006.01)
*B65D 50/00* (2006.01)

(58) Field of Classification Search
USPC ..... 220/831, 810, 265–6
See application file for complete search history.

(56) References Cited

U.S. PATENT DOCUMENTS 4,047,495 A 9/1977 O'Brian
4,158,902 A * 6/1979 Chernack ..... B65D 47/0819 16/227
4,170,315 A 9/1979 Dubach et al.
4,358,032 A 11/1982 Libit
4,557,393 A 12/1985 Boik
4,795,044 A 1/1989 Beck
4,919,286 A 4/1990 Agbay, Sr.
4,984,716 A 1/1991 Beck
5,048,715 A 9/1991 Wolff
5,088,612 A 2/1992 Storar
5,531,349 A 7/1996 Wojcik
5,755,352 A 5/1998 Wojcik
5,779,110 A 7/1998 Brown
5,785,203 A 7/1998 Arshinoff
5,819,965 A 10/1998 King
5,901,885 A 5/1999 Iida
5,992,659 A 11/1999 Nofer
5,996,859 A 12/1999 Beck
6,253,939 B1 7/2001 Wan
6,299,005 B1 10/2001 Higgins
6,415,965 B2 7/2002 Nyman
6,419,101 B1 7/2002 Hessel
6,478,184 B2 11/2002 Berge
6,481,588 B1 11/2002 Wagner
6,609,624 B2 8/2003 Goto
6,848,603 B2 2/2005 Gaiser
7,051,888 B2 * 5/2006 Antier ..... B65D 41/485 215/235
7,073,679 B1 * 7/2006 Lagler ..... B65D 47/0809 220/259.1
7,281,638 B2 10/2007 Hierzer
7,299,937 B2 * 11/2007 Antier ..... B65D 41/485 215/235
7,303,088 B2 12/2007 Sawyer
7,469,795 B2 12/2008 Druitt
7,617,954 B2 * 11/2009 Skillin ..... B65D 47/0819 215/245
7,658,295 B2 2/2010 Hoepner
7,789,254 B2 * 9/2010 Geho ..... B65D 41/48 215/252
8,708,175 B2 * 4/2014 Smith ..... B65D 43/0235 215/235
8,833,584 B2 9/2014 Groubert
9,334,097 B2 5/2016 Skillin
9,415,909 B2 8/2016 Druitt
9,650,184 B2 5/2017 Fily
9,821,934 B2 11/2017 Bevan
9,930,996 B2 4/2018 Wiggins
9,932,158 B2 4/2018 Rognard
10,131,477 B2 11/2018 Robert
10,138,031 B2 11/2018 Del Rosario Roy
10,138,035 B2 11/2018 Loukov
10,336,512 B2 7/2019 Stoneberg
10,358,273 B2 7/2019 Benoit-Gonin
10,442,591 B2 10/2019 Rognard
2002/0166835 A1 11/2002 Carter
2003/0192853 A1 10/2003 Zapata
2004/0178166 A1 * 9/2004 Antier ..... B65D 41/485 215/235
2005/0011855 A1 1/2005 Zapata
2005/0087550 A1 * 4/2005 Skillin ..... B65D 47/0828 222/153.01
2006/0191948 A1 8/2006 Wisniewski
2006/0219652 A1 10/2006 Grant
2006/0231518 A1 10/2006 Suffa
2007/0102389 A1 * 5/2007 Hoepner ..... B65D 55/024 215/235
2007/0102390 A1 5/2007 Hoepner
2007/0102392 A1 * 5/2007 Hoepner ..... B65D 47/0885 215/237
2007/0131641 A1 6/2007 Higgins
2007/0151993 A1 7/2007 Yelland
2007/0187410 A1 8/2007 Legorreta
2008/0023477 A1 1/2008 Markert
2008/0047976 A1 2/2008 Scheer
2008/0173647 A1 7/2008 Ochoa Laburu
2008/0237178 A1 10/2008 Ochoa Laburu
2008/0251573 A1 10/2008 Nobilet
2008/0257852 A1 10/2008 Herald
2011/0049154 A1 3/2011 Michalsky
2011/0068079 A1 3/2011 Luzatto
2012/0024815 A1 2/2012 Kwon
2012/0164038 A1 * 6/2012 Loehn ..... B01L 3/50825 422/551
2012/0260487 A1 10/2012 Nichols
2013/0001184 A1 * 1/2013 Groubert ..... B65D 47/0871 215/235
2015/0114984 A1 4/2015 Mehdizadeh
2015/0129531 A1 5/2015 Gatton
2016/0101914 A1 4/2016 Logel
2016/0264316 A1 9/2016 Quinn
2016/0355306 A1 12/2016 Robin
2018/0086510 A1 3/2018 Berroa Garcia
2018/0118423 A1 5/2018 Bois
2018/0134469 A1 5/2018 Faria
2018/0186521 A1 7/2018 Hein
2018/0222645 A1 8/2018 Nicholes
2018/0312308 A1 11/2018 Hein
2019/0039787 A1 2/2019 Benoit-Gonin

FOREIGN PATENT DOCUMENTS

CA 2702174 A1 4/2009
CA 2937288 A1 9/2015
CA 2961309 A1 9/2017
CA 3016406 A1 9/2017
CA 2990674 A1 9/2018
CA 2828903 C 4/2019
DE 1229447 B 11/1966
DE 4123732 A1 1/1992
DE 20220109 U1 5/2004
DE 202005012983 U1 1/2006
DE 102005038929 A1 2/2007
DE 202013004593 U1 9/2014
DE 202016101824 U1 8/2016
DE 202015003160 U1 9/2016
DE 102015116784 A1 4/2017
EM 285671-0001 1/2005
EM 524442-0009 3/2006
EM 1599630-0002 10/2009
EM 1207112-0003 9/2010
EM 1807819-0001 1/2011
EM 1955337-0002 11/2011
EM 2073569-0001 7/2012
EM 2364596-0001 12/2013
EM 2734897-0001 7/2015
EM 2812446-0001 A1 10/2015
EM 2949404-0004 A1 1/2016
EM 3621457-0001 1/2017
EM 5316734-0001 A1 6/2018
EP 345403 A1 12/1989
EP 515348 A1 11/1992
EP 897877 A1 2/1999
EP 908394 A1 4/1999
EP 997386 A1 5/2000
EP 1192887 A2 4/2002
EP 1317961 A1 6/2003
EP 1319605 A1 6/2003
EP 1516825 A1 3/2005
EP 1619134 A1 1/2006
EP 1704099 A1 9/2006
EP 1799577 A1 6/2007
EP 2204333 A1 7/2010

(56) References Cited

FOREIGN PATENT DOCUMENTS

| | | | |
|---|---|---|---|
| EP | 2250102 | A1 | 11/2010 |
| EP | 2327632 | A1 | 6/2011 |
| EP | 2402261 | A1 | 1/2012 |
| EP | 2427387 | A1 | 3/2012 |
| EP | 2468404 | A2 | 6/2012 |
| EP | 2511189 | A1 | 10/2012 |
| EP | 2654958 | A1 | 10/2013 |
| EP | 2848552 | A1 | 3/2015 |
| EP | 3081505 | A1 | 10/2016 |
| EP | 3098048 | A1 | 11/2016 |
| EP | 3135600 | A1 | 3/2017 |
| EP | 2953863 | B1 | 9/2017 |
| EP | 3083428 | B1 | 9/2017 |
| EP | 3219636 | A1 | 9/2017 |
| EP | 3305680 | B1 | 9/2019 |
| ES | 213088 | A1 | 4/1954 |
| ES | 2133088 | A1 | 8/1999 |
| ES | 1042653 | U | 9/1999 |
| ES | 1076277 | U | 2/2012 |
| GB | 2068913 | A | 8/1981 |
| GB | 2076378 | A | 12/1981 |
| GB | 2216505 | A | 10/1989 |
| JP | 3161698 | A | 7/1991 |
| JP | 3277457 | A | 12/1991 |
| JP | 4235096 | A | 8/1992 |
| JP | 4357990 | A | 12/1992 |
| JP | 5012244 | A | 1/1993 |
| JP | 5024037 | A | 2/1993 |
| JP | 5073639 | A | 3/1993 |
| JP | 5080931 | A | 4/1993 |
| JP | 5085518 | A | 4/1993 |
| JP | 5125113 | A | 5/1993 |
| JP | 5144068 | A | 6/1993 |
| JP | 5306856 | A | 11/1993 |
| JP | 6116474 | A | 4/1994 |
| JP | 6124783 | A | 5/1994 |
| JP | 6157955 | A | 6/1994 |
| JP | 6041603 | A | 2/1999 |
| JP | 6133381 | A | 5/1999 |
| JP | 2001163346 | A | 6/2001 |
| JP | 2002362603 | A | 12/2002 |
| JP | 3387035 | B2 | 3/2003 |
| JP | 2003521103 | A | 7/2003 |
| JP | 2003526776 | A | 9/2003 |
| JP | 2005022673 | A | 1/2005 |
| JP | 2006256623 | A | 9/2006 |
| JP | 3953318 | B2 | 8/2007 |
| JP | 2008074468 | A | 4/2008 |
| JP | 2008125965 | A | 6/2008 |
| JP | 2008137657 | A | 6/2008 |
| JP | 2008260538 | A | 10/2008 |
| JP | 2008296935 | A | 12/2008 |
| JP | 2009184709 | A | 8/2009 |
| JP | 2010089807 | A | 4/2010 |
| JP | 4470224 | B2 | 6/2010 |
| JP | 2010528805 | A | 8/2010 |
| JP | 4736133 | B2 | 7/2011 |
| JP | 4789986 | B2 | 10/2011 |
| JP | 4846466 | B2 | 12/2011 |
| JP | 4906454 | B2 | 3/2012 |
| JP | 4987676 | B2 | 7/2012 |
| JP | 2013184726 | A | 9/2013 |
| JP | 2013184727 | A | 9/2013 |
| JP | 5380227 | B2 | 1/2014 |
| JP | 2014009000 | A | 1/2014 |
| JP | 5600712 | B2 | 10/2014 |
| JP | 2015003736 | A | 1/2015 |
| JP | 2015085976 | A | 5/2015 |
| JP | 2015085979 | A | 5/2015 |
| JP | 2015101401 | A | 6/2015 |
| JP | 2015107815 | A | 6/2015 |
| JP | 2015151135 | A | 8/2015 |
| JP | 2015160649 | A | 9/2015 |
| JP | 2015525191 | A | 9/2015 |
| JP | 2015525293 | A | 9/2015 |
| JP | 2015182797 | A | 10/2015 |
| JP | 2015224080 | A | 12/2015 |
| JP | 2015227195 | A | 12/2015 |
| JP | 5897169 | B2 | 3/2016 |
| JP | 2016507726 | A | 3/2016 |
| JP | 5917065 | B2 | 5/2016 |
| JP | 2016069019 | A | 5/2016 |
| JP | 2016069023 | A | 5/2016 |
| JP | 2016078930 | A | 5/2016 |
| JP | 2016088538 | A | 5/2016 |
| JP | 2016097990 | A | 5/2016 |
| JP | 2016099236 | A | 5/2016 |
| JP | 2016101948 | A | 6/2016 |
| JP | 2016120956 | A | 7/2016 |
| JP | 5972767 | B2 | 8/2016 |
| JP | 2016137914 | A | 8/2016 |
| JP | 2016141431 | A | 8/2016 |
| JP | 2016166022 | A | 9/2016 |
| JP | 2016179844 | A | 10/2016 |
| JP | 2016210440 | A | 12/2016 |
| JP | 2016222310 | A | 12/2016 |
| JP | 2016222311 | A | 12/2016 |
| JP | 2017013840 | A | 1/2017 |
| WO | 1994004426 | A1 | 3/1994 |
| WO | 1994004427 | A1 | 3/1994 |
| WO | 2000034142 | A1 | 6/2000 |
| WO | 2002098756 | A2 | 12/2002 |
| WO | 2003006333 | A2 | 1/2003 |
| WO | 2003016162 | A1 | 2/2003 |
| WO | 2003022690 | A2 | 3/2003 |
| WO | 2004043820 | A1 | 5/2004 |
| WO | 2004080839 | A1 | 9/2004 |
| WO | 2005058722 | A2 | 6/2005 |
| WO | 2005061343 | A1 | 7/2005 |
| WO | 2006023794 | A2 | 3/2006 |
| WO | 2006027484 | A1 | 3/2006 |
| WO | 2006037431 | A1 | 4/2006 |
| WO | 2006098611 | A1 | 9/2006 |
| WO | 2009048273 | A2 | 4/2009 |
| WO | 2009101117 | A1 | 8/2009 |
| WO | 2010128286 | A1 | 11/2010 |
| WO | 2012083995 | A1 | 6/2012 |
| WO | 2013012558 | A1 | 1/2013 |
| WO | 2013165404 | A1 | 11/2013 |
| WO | 2014073917 | A1 | 5/2014 |
| WO | 2014177900 | A1 | 11/2014 |
| WO | 2014189513 | A1 | 11/2014 |
| WO | 2015001153 | A1 | 1/2015 |
| WO | 2015002110 | A1 | 1/2015 |
| WO | 2015002296 | A1 | 1/2015 |
| WO | 2015023829 | A1 | 2/2015 |
| WO | 2015128847 | A1 | 9/2015 |
| WO | 2015141494 | A1 | 9/2015 |
| WO | 2016113441 | A1 | 7/2016 |
| WO | 2016129326 | A1 | 8/2016 |
| WO | 2016159491 | A1 | 10/2016 |
| WO | 2016167101 | A1 | 10/2016 |
| WO | 2016186983 | A1 | 11/2016 |
| WO | 2017001854 | A1 | 1/2017 |
| WO | 2017001855 | A1 | 1/2017 |
| WO | 2017017892 | A1 | 2/2017 |
| WO | 2017024106 | A1 | 2/2017 |
| WO | 2017149167 | A1 | 9/2017 |
| WO | 2019031779 | A1 | 2/2019 |
| WO | 2019043274 | A1 | 3/2019 |
| WO | 2019110853 | A1 | 6/2019 |
| WO | 2019113681 | A1 | 6/2019 |
| WO | 2019175740 | A2 | 9/2019 |

* cited by examiner

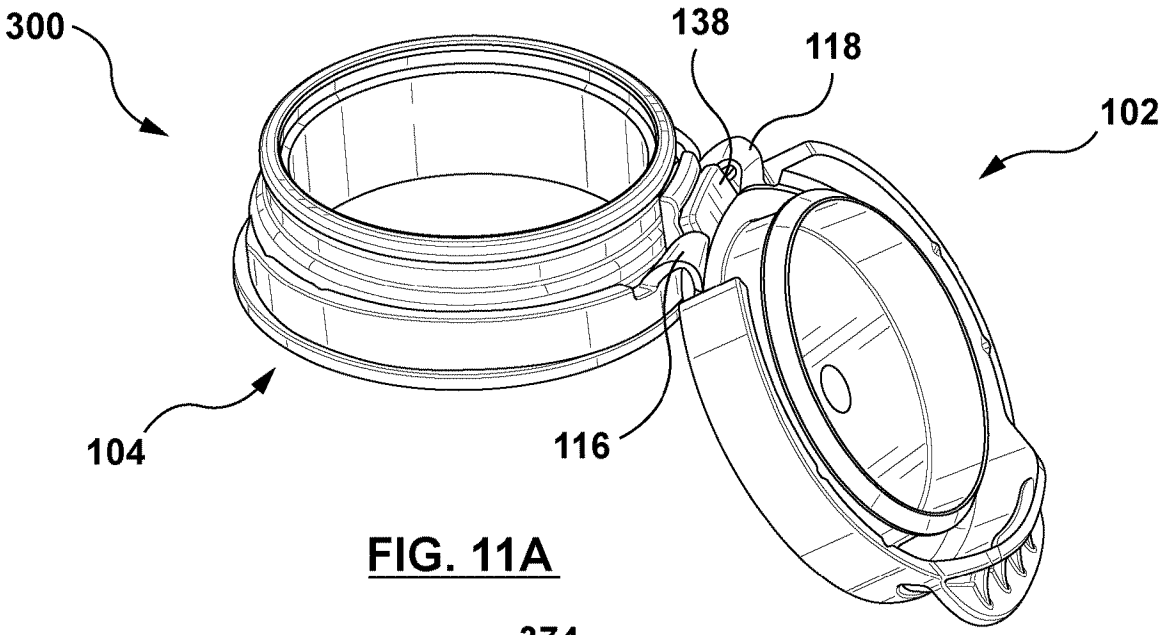
FIG. 11A
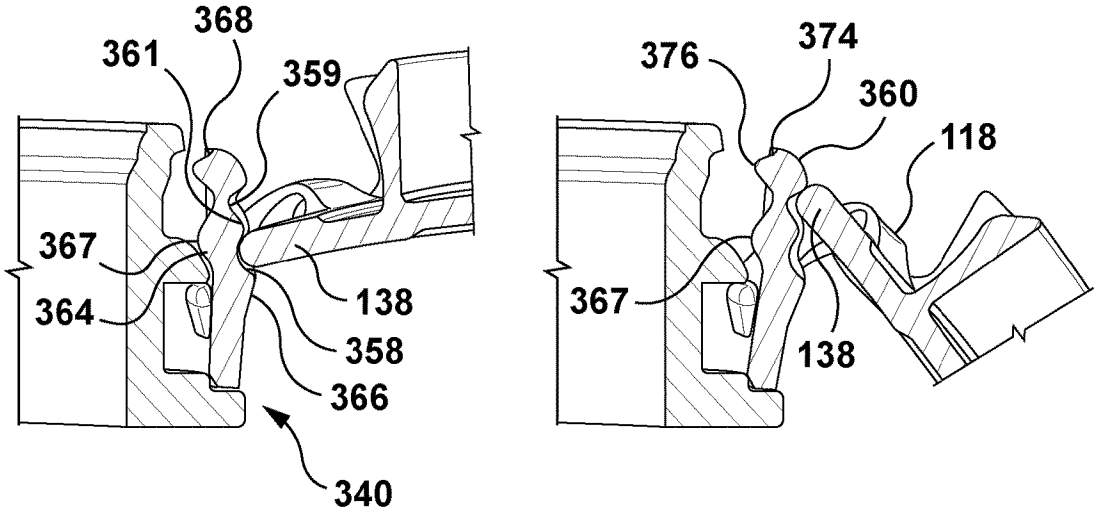
FIG. 11B
FIG. 11C
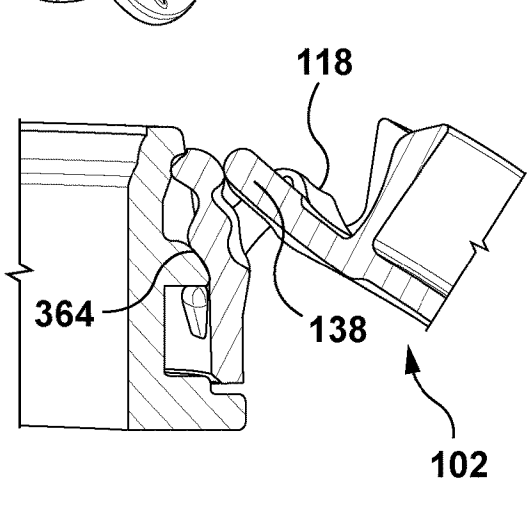
FIG. 11D

CLOSURE CAP FOR A CONTAINER

TECHNICAL FIELD

The present invention relates to a closure cap for a liquid container, and more particularly to a closure cap having a lid and a shell, and a hinge region for pivotally connecting the lid to the shell and for locking the lid in an open position thereof.

BACKGROUND

Particularly in the beverage and food industry, there is a demand for closure caps which can be sealingly fitted onto the neck of a container with liquid contents and have a pivotable lid that can be held in an open position.

In general, such closure caps are injection molded articles. In essence they consist of a lid, a cylindrical body for sealingly fitted onto a container neck, a hinge for pivotally connecting the lid to the cylindrical body and means for locking the lid in an open position thereof. For protecting the lid from unauthorized opening or inappropriate manipulation, the lid usually is connected to the cylindrical body via frangible bridges which break upon a first opening of the lid.

European Patent Application No. 0 908 349 A1 (KLOPFER; PUBLISHED: 14 Apr. 1999) discloses a closure cap for a container having a lid pivotally connected to a fastening ring of the closure cap and means for locking the lid in an open position at an angle of about 90°. The joint is provided by a thin film formed in an upper wall portion of the fastening ring. The locking means consist of a T-shaped stub projecting from a rim of the lid, and a pair of profiled sprung jaws extending from a lower wall portion of the fastening ring. For locking the lid in its open position, the T-shaped stub is pressed between the profiled jaws which grip the same with a ratchet grip.

Applied to a beverage container, the opening angle of the lid of about 90° is unsatisfactory as a lid in such a position renders drinking from the container neck inconvenient. Further, reclosing the lid is cumbersome as in a first place the stub must be disengaged from the sprung jaws.

US Patent Application No. 2004/0178166 A1 (ANTIER et al.; PUBLISHED 16 Sep. 2004) discloses a closure cap having a lid pivotally connected to a skirt of the closure cap and means for locking the lid in an open position at an angle of about 180°. The joint is provided by a pair of elastic lamellae spaced apart from each other and formed in upper wall portions of the skirt and lower wall portions of a rim of the lid. The locking means consist of a tongue-shaped projection integrally formed with the lid and extending beyond the rim, and a wall section of the skirt defined by the spacing between the lamellae. The wall section serves to provide an abutment against which the tongue-shaped projection rests in the open position of the lid.

Whether or not the lid can be held in a position with an opening angle of 180° fully depends on the compliance with given dimensions of the tongue-shaped extension. Thus, any deviations from such given dimensions, likely to occur during the production of the closure cap, inevitably render the locking mechanism to fail.

SUMMARY

The object underlying the present invention is to provide a closure cap for a container having a pivotable lid which, at a wide opening angle thereof, can be reliably locked and which also can be readily reclosed.

This object is solved by a closure cap having the features defined by claim 1.

According to the present invention, the hinge region for pivotally connecting the lid to the shell of the closure cap and for locking the lid in a final open position comprises a pair of elongate hinge elements spaced apart from each other, and a ratchet-like member disposed therebetween. The hinge elements are integrally formed with the shell and the top panel of the lid. Each hinge element has a lower portion having a wall thickness and an intermediate portion with an inwardly sloping outer face, thereby providing a wall thickness of an upper portion of the hinge element which, relative to the lower portion of the hinge element, is of a reduced thickness. The ratchet-like member is integrally formed with the shell and has a body with outer and inner contours, each thereof having a lower portion, an intermediate portion and an upper portion. The intermediate portion of the outer contour has at least one inward curvature configured for guiding an end portion of the tongue towards the upper portion of the outer contour during opening of the lid. The upper portion has an outward curvature which provides an abutment for the end portion of the tongue in the final open position of the lid. It is worth noting that in its final open position, the lid can reliably be locked at a wide opening angle, so that the closure cap, if applied to a beverage container, allows for conveniently drinking from the container neck. Further, it is worth noting that the lid, from its final open position, can conveniently be reclosed.

Preferably, the lower portion of the hinge elements has a wall thickness that corresponds to a wall thickness of the shell.

Preferably, the upper portions of the hinge elements each form a recess in the top panel of the lid, so that the recesses in concert form a tongue in the top panel of the lid.

In order to advantageously support the body of the ratchet-like member in the final open position of the lid, the intermediate portion of its inner contour preferably comprises a profile configured to abut, at least in part, against a pilfer proof of a container neck.

Preferably, part of the upper portion of the inner contour of the body comprises a profile that is configured to abut, at least in part, against a portion of a container neck in the final open position of the lid.

According to a first embodiment of the outer contour of the body of the ratchet-like member, the lower portion of the outer contour has a flat face sloping outwardly at an upper section thereof. In this way, it is advantageously ensured that the end portion of the tongue during opening of the lid is properly guided into the inward curvature of the intermediate portion of the outer contour, which inward curvature, in terms of a first variant of this first embodiment, has a substantially semi-circular profile and, in terms of a second variant of this first embodiment, the intermediate portion has a concave profile. An inward curvature having a substantially semi-circular profile has the advantage that it is associated with material savings. The outward curvature of the upper portion of the outer contour has a substantially semi-circular profile which profile thus advantageously supports the sliding of the end portion of the tongue towards an abutment of the outward curvature against which the end portion of the tongue is firmly held in the final open position of the lid. The substantially semi-circular profile of the upper portion of the outer contour preferably has an end section with a nose-like profile such that in the final open position of the lid, the end section either as such can abut against a neck finish of a container or allows an end section of the upper portion of the inner contour to be brought into such an abutment.

According to a second embodiment of the outer contour of the body of the ratchet-like member, the lower portion of the outer contour has a flat profile sloping outwardly, the intermediate portion of the outer contour has first and second inward curvatures with an outward curvature disposed therebetween, and the upper portion of the outer contour has an outward curvature having an end section with a nose-like profile.

Providing a profile of the intermediate and upper portions of the outer contour of the body in terms of the above second embodiment of an outer contour has the advantage that the end portion of the tongue, during opening of the lid, undergoes a stepwise guidance, wherein, in interaction with the second inward curvature of the intermediate portion and part of the outward curvature of the upper portion, the tongue, by virtue of the hinge elements, can be retained in a position at which the lid is in an intermediate open position with an opening angle that is wider than that the lid has in its final open position where the intermediate portion of the inner contour of the body is, at least in part, in abutment with a pilfer proof of a container neck.

According to the aforesaid second embodiment of the outer contour of the body, the profile of the intermediate portion of the outer contour preferably is such that the first inward curvature has a substantially semi-circular profile, the second inward curvature has a substantially semi-circular profile, and the outward curvature disposed therebetween has a substantially semi-circular profile. Preferably, a width of the second semi-circularly profiled inward curvature of the intermediate portion of the outer contour is less than a width of the second semi-circularly profiled inward curvature of said intermediate portion. The outward curvature of the upper portion of the outer contour preferably has a substantially semi-circular profile, and preferably a width thereof is greater than a width of the semi-circularly profiled outward curvature of the intermediate portion of the outer contour. The intermediate and upper portions of the outer contour profiled in such a manner provide for a smooth stepwise guidance of the tongue towards an abutment with the upper portion, while the substantially semi-circular profile of the second inward curvature of the intermediate portion conveniently allows the tongue to be held in an abutment with part of the outward curvature of the upper portion in an intermediate open position of the lid.

According to a first embodiment of the inner contour of the body of the ratchet-like member, the lower portion of the inner contour has a flat profile and the upper portion of the inner contour of the body has a flat profile. The intermediate portion has an inward curvature configured to abut, at least in part, against a pilfer proof of a container neck in the final open position of the lid. Providing such an abutment advantageously supports the body in the final open position of the lid.

According to a second embodiment of the inner contour of the body of the ratchet-like member, the lower portion of the inner contour has a flat profile. The intermediate portion of the inner contour has an outward curvature and an end section having a substantially flat profile. The outward curvature is such positioned that it, at least in part, abuts against a pilfer proof of a container neck in the final open position of the lid, thereby advantageously supporting the body in the final open position of the lid. The upper portion of the inner contour has an outward curvature.

Preferably, the outward curvature of the intermediate portion of the inner contour and the outward curvature of the upper portion of the inner contour each have a convex profile having an apex. Advantageously, the convex profile of the intermediate portion is such positioned that a lower portion thereof abuts against a pilfer proof of a container neck in the final open position of the lid.

According to an embodiment of the closure cap of the present invention, the shell, on a side opposite to the side of the hinge region, has a wall section of reduced height which is provided by way of an inverted trapezoid cut-out having identically inclined cut lines. The wall suspended from the top panel of the lid has a complementarily shaped wall section which is received in the aforesaid wall section of the shell in a closed position of the lid. For opening the closure cap conveniently, the complementarily shaped wall section of the wall suspended from the top panel preferably carries a tongue-like projection integrally formed therewith and having an arced-shaped support structure.

In order to provide that the closure cap can be snugly fitted onto a container neck, the shell, along an inner circumference thereof, comprises a plurality of cam-like stopper components spaced apart from each other and configured to slide over a pilfer proof of a container neck during capping of the closure cap. During capping a lower surface of the cam-like stopper components helps to radially stretch the shell of the closure cap, while during opening of the lid an upper surface of the cam-like stopper components cooperates with a lower surface of the pilfer proof of the container neck to retain the shell on the container neck. In order to stiffen the wall section of the shell of reduced height, adjacent to each of the inclined cut lines of the inverted trapezoid cut-out providing that wall section, the respective cam-like stopper component preferably has a body portion having an inclination similar to that of the inclined cut-lines.

For protecting the closure cap from unauthorized opening or inappropriate manipulation, the lid is connected to the shell via a plurality of frangible bridges which break upon a first opening of the lid. The bridges are each positioned above a space defined by two adjacent cam-like stopper components. In order to allow a user a more precise and convenient opening of the lid, the plurality of bridges preferably is provided only in the front half of the closure cap.

In order to provide a proper seal for the liquid content of a container capped with a closure cap of the present invention, the bottom face of the top panel of the lid comprises a plug seal shaped to sealingly fit into a neck finish of a container neck.

DETAILED DESCRIPTION OF THE DRAWINGS

The non-limiting embodiments of the present invention will be more fully appreciated by reference to the accompanying drawings, in which:

FIG. 11A depicts a perspective view of the closure cap shown in FIGS. 5 and 8 in its final open position, which closure cap has a ratchet-like member having a body with an outer contour according to the second embodiment of an outer contour, and an inner contour according to the second embodiment of an inner contour;

FIGS. 11B to 11D depict sectional views of the closure cap of FIG. 11A and show the lid in interaction with the hinge elements and the body of the ratchet-like member during opening of the lid and in its final open position.

The drawings serve the purpose of illustration and are not to scale.

DETAILED DESCRIPTION OF THE NON-LIMITING EMBODIMENTS

Reference will now be made to non-limiting embodiments of a closure cap according to the present invention. It should be understood that other modifications and equivalents will be evident to those skilled in the art in view of the non-limiting embodiments disclosed herein and that those variants should be considered to be within the scope of the present invention.

Furthermore, it will be recognized by those skilled in the art that certain structural and/or operational details of the non-limiting embodiments discussed hereinafter may be modified or amended.

Figure 1:
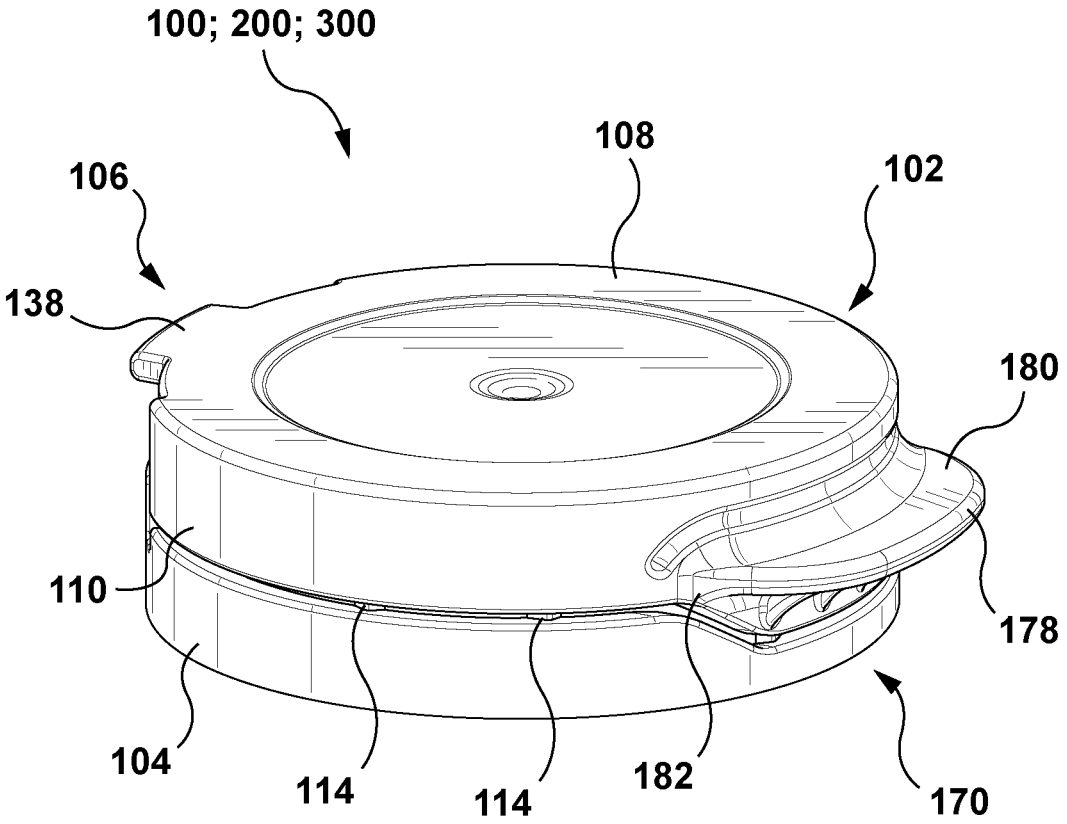
FIG. 1 depicts a perspective view from the above, oriented towards the front half of a closure cap provided according to embodiments of a closure cap of the present invention.

As illustrated in FIG. 1, closure cap 100, 200 and 300, respectively, comprises a lid 102, a shell 104 and a hinge region 106 which is configured for pivotally connecting the lid 102 to the shell 104 and for locking the lid 102 in an open position thereof. The lid 102 comprises a substantially circular top panel 108 having a tongue 138 adjacent the hinge region 106, and a wall 110 suspended from a bottom face 112 (shown in FIG. 2) of the top panel 108. Wall 110 is connected to the shell 104 via a plurality of bridges 114 which break upon a first opening of the lid 102. For allowing a more precise and convenient opening of the lid 102, the bridges 114 are only provided in the front half of the closure cap. Opposite to the hinge region 106, the wall 110 carries a tongue-like projection 178 to be gripped by a user for opening the lid 102. The tongue-like projection 178 is integrally formed with the wall 100 and has an arc-shaped support structure 182.

Figure 2:
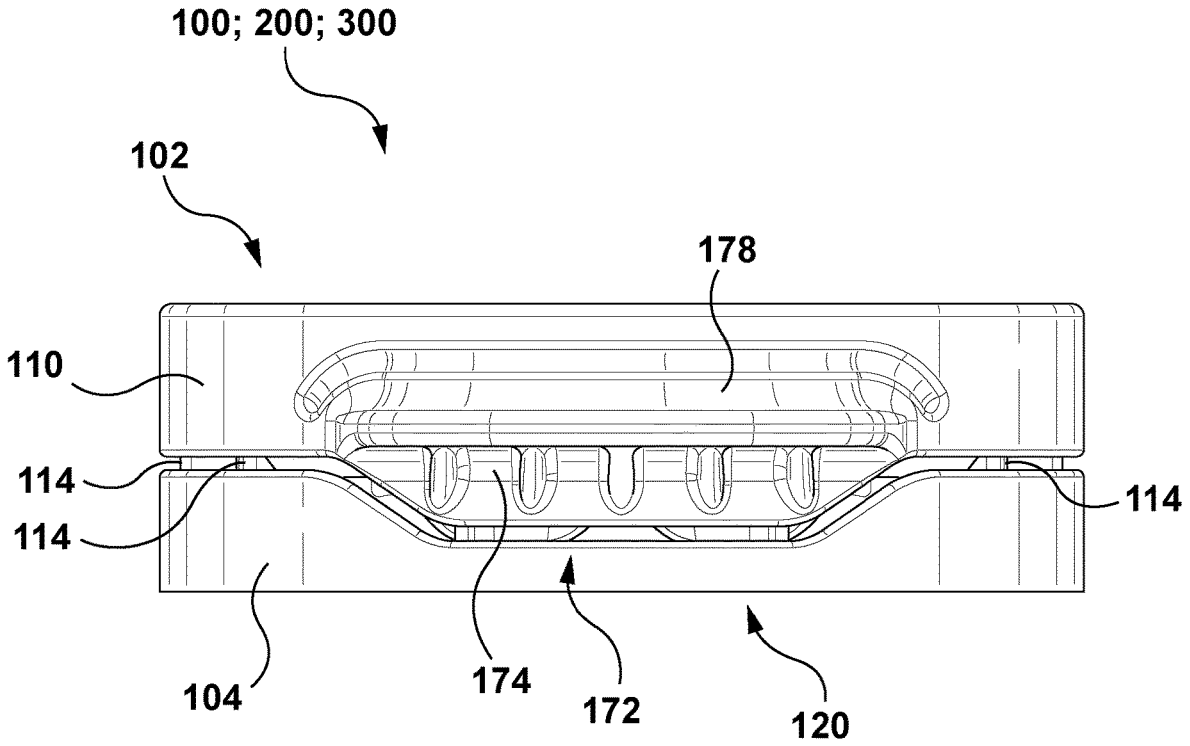
FIG. 2 depicts an elevation view of the front half of the closure cap of FIG. 1.

As it becomes more apparent from FIG. 2, the shell 104 has a wall section 170 of reduced height provided by way of an inverted trapezoid cut-out 172 having identically inclined cut lines. In the closed position of the lid, wall section 170 accommodates a complementarily shaped wall section 174 of the wall 110, which wall section 174 carries the aforesaid tongue-like projection 178.

Figure 3:
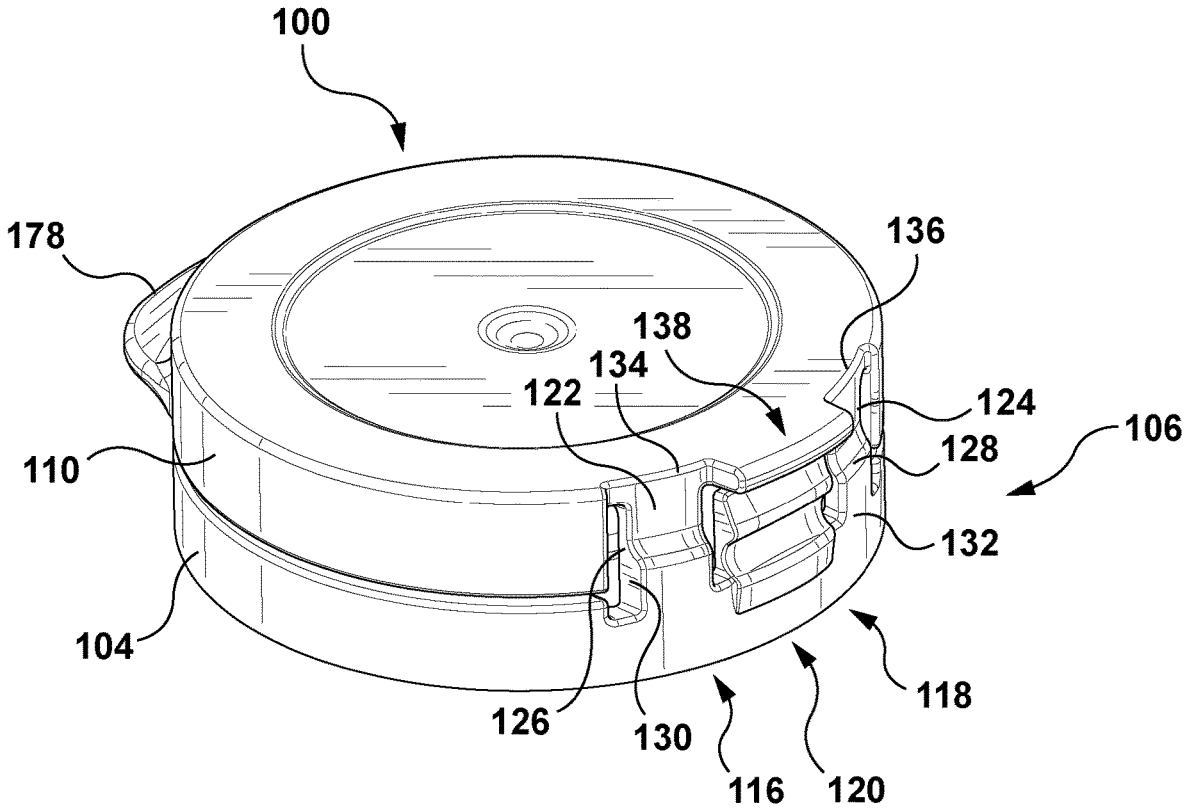
FIG. 3 depicts a perspective view from the above, oriented towards the back half of the closure cap shown in FIG. 1, which closure cap has a ratchet-like member with a body having an outer contour according to a first variant of a first embodiment of the outer contour.

FIG. 3 depicts the closure cap shown in FIGS. 1 and 2 with particular emphasis on the hinge region 106 which comprises a pair of elongate hinge elements 116, 118 spaced apart from each other and a ratchet-like member 120 disposed therebetween. The hinge elements 116, 118 are integrally formed with the shell 104 and the lid 102. Each hinge element 116, 118 has a lower portion 130, 132 having a wall thickness of the shell 104, and an intermediate portion 126, 128 having an outer face which, relative to the lower portion, slopes inwardly and thereby provides an upper portion 122 and 124, respectively, having a wall of reduced thickness. In this way, the upper portions 122, 124 of the hinge elements 116, 118 each form a recess 134, 136 in the top panel 108 which recesses 134, 136 in turn form the aforesaid tongue 138 in the top panel 108 of the lid.

As set out above, the ratchet-like member 120 has a body with outer and inner contours each having a lower portion, an intermediate portion and an upper portion.

Figure 6:
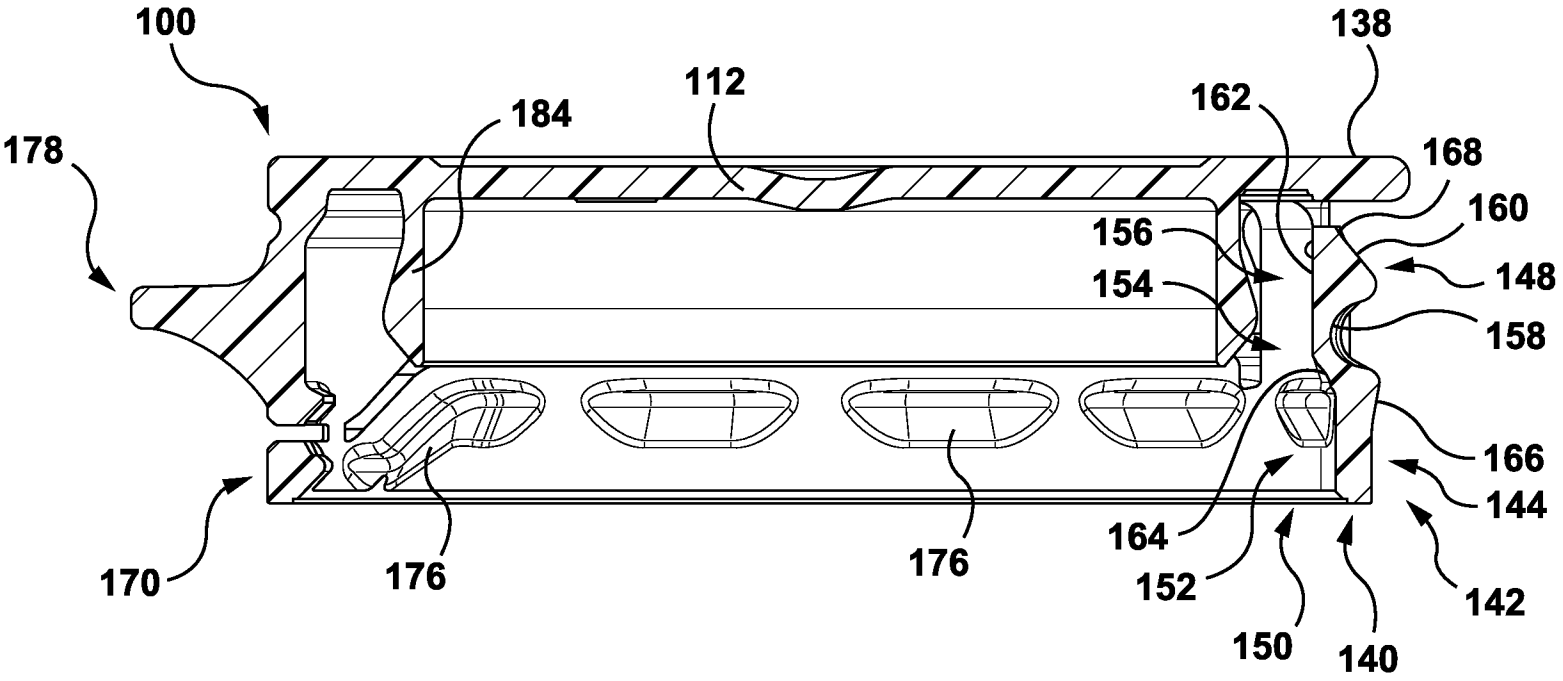
FIG. 6 depicts a sectional view of the closure cap shown in FIG. 3, which closure cap has a ratchet-like member with a body having an outer contour according to the first variant of the first embodiment of the outer contour and an inner contour according to a first embodiment of the inner contour.

The ratchet-like member 120 employed in the closure cap 100 of FIG. 3, has a body 140 with an outer contour 142 profiled in accordance with a first variant of a first embodiment of an outer contour, and an inner contour 150 profiled in accordance with a first embodiment of an inner contour. The inner 150 and outer contours 142 of body 140 in more detail are depicted in FIG. 6. Accordingly, one will appreciate the following. The lower portion 144 of the outer contour 142 of body 140 has a flat profile with an end section 166 sloping outwardly. The intermediate portion 146 of the outer contour 142 of body 140 has an inward curvature 158 with a substantially semi-circular profile, and the upper portion 148 of the outer contour 142 has an outward curvature 160 which has a substantially semi-circular profile and an end section 168 (more clearly shown in FIGS. 9B to 9D) having a nose-like profile. The lower portion 152 of the inner contour 150 of body 140 has a flat profile, and the intermediate portion 154 of the inner contour 150 of body 140 has an inward curvature 164 having a concave profile. The upper portion 156 of the inner contour 150 of body 140 has a flat profile 162.

FIGS. 9A to 9D supplement FIGS. 3 and 6 in that as they illustrate on how lid 102 of closure cap 100, via hinge region 106 employing a ratchet-like member 120 having body 140 with the aforesaid outer 142 and inner 150 contours, is brought into and locked in its final open position. In the depicted embodiment, the opening angle of the lid 102 is about 210° (shown in FIGS. 9A and 9D). In order to also illustrate on how the intermediate portion 154 of the inner contour 150 of body 140 supports body 140 in the final open position of the lid 102, the cross-sectional views of FIGS. 9B to 9D also depict part of a container neck.

Figure 9A:
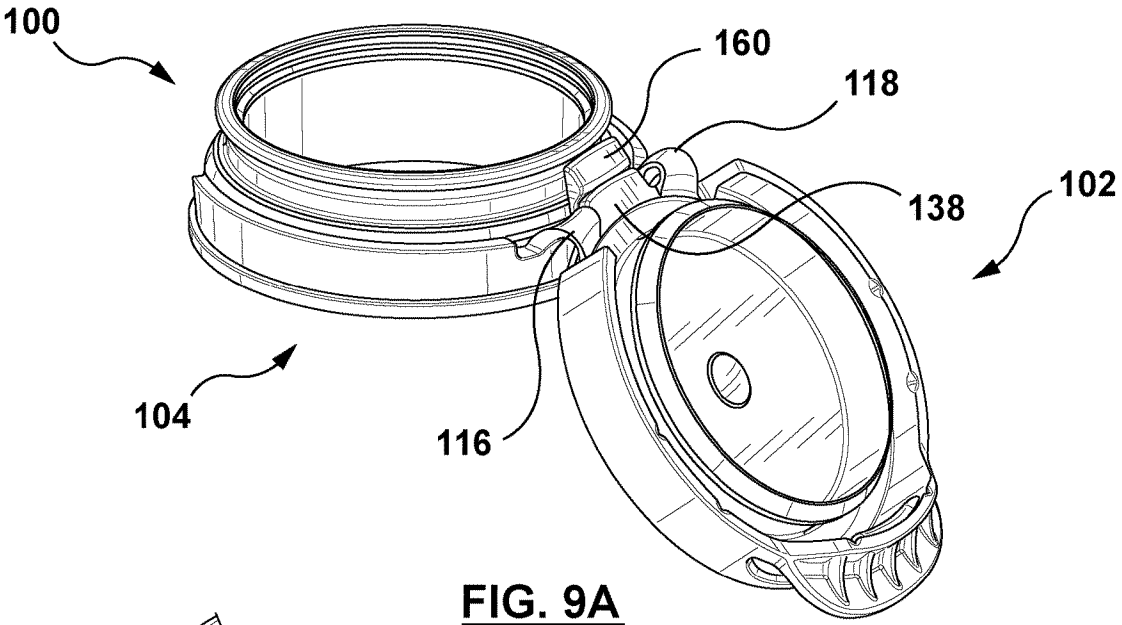
FIG. 9A depicts a perspective view of the closure cap shown in FIGS. 3 and 6 in its final open position, which closure cap has a ratchet-like member having a body with an outer contour according to the first variant of the first embodiment of the outer contour, and an inner contour according to the first embodiment of the inner contour.
Figure 9C:
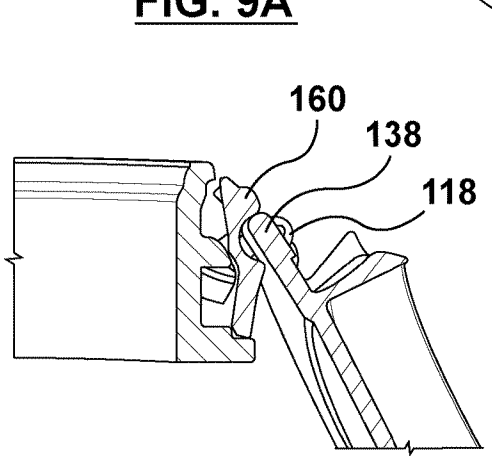
FIGS. 9B to 9D depict sectional views of the closure cap of FIG. 9A and show the lid in interaction with the hinge elements and the body of the ratchet-like member during opening of the lid and in its final open position.
Figure 9D:
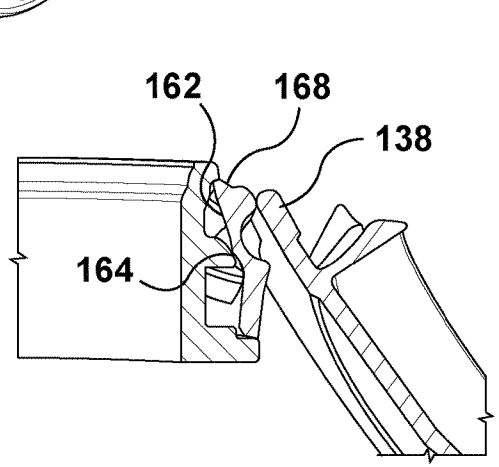
Figure 9B:
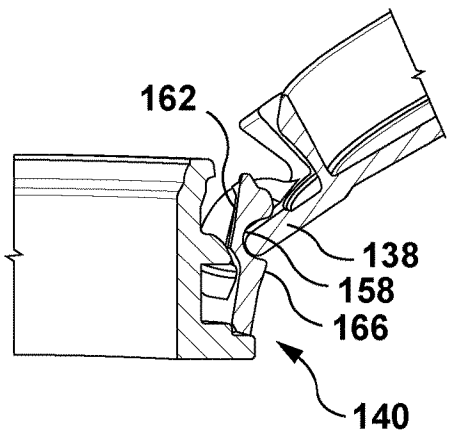

Under continued reference to FIG. 6, one will appreciate from FIGS. 9B to 9D the following.

From FIG. 9B one will appreciate that the outwardly sloping end section 166 of the lower portion 144 of the outer contour 142 of body 140 ensures that during opening of lid 102, an end portion of tongue 138 formed in the top panel 108 of lid 102, is properly received by the substantially semi-circularly profiled inward curvature 158 of the intermediate portion 146 of outer contour 142. From FIGS. 9C and 9D one will appreciate that by way of said substantially semi-circular profile of the inward curvature 158 of the intermediate portion 146 and the substantially semi-circular profile of the outward curvature 160 of the upper portion 148 of the outer contour 142, an end portion of tongue 138 is guided towards an abutment of the outward curvature 160 of said upper portion 148, against which abutment the tongue 138 is firmly held in the final open position of lid 102 by virtue of the hinge elements 116 and 118. From FIG. 9D, showing the lid 102 in its final open position, one will appreciate that body 140 at this position of lid 102 is advantageously supported by the intermediate portion 154 of its inner contour 150, namely in that the concavely profiled inward curvature 164 of the intermediate portion 154 abuts, in part, against a pilfer proof of a container neck. FIG. 9D further shows that an end section of the flat profile 162 of upper portion 156 of the inner profile 150 of body 140 is in abutment with an uppermost portion of a container neck finish. Although such an abutment provides further support for body 140, it is not necessarily required for holding the lid 102 via tongue 138 in its final open position. Whether or not such an abutment occurs, rather depends on the design of the outer contour of the uppermost portion of a container neck finish and/or on the plastic material used in the injection molding of the closure cap of the present invention.

Figure 4:
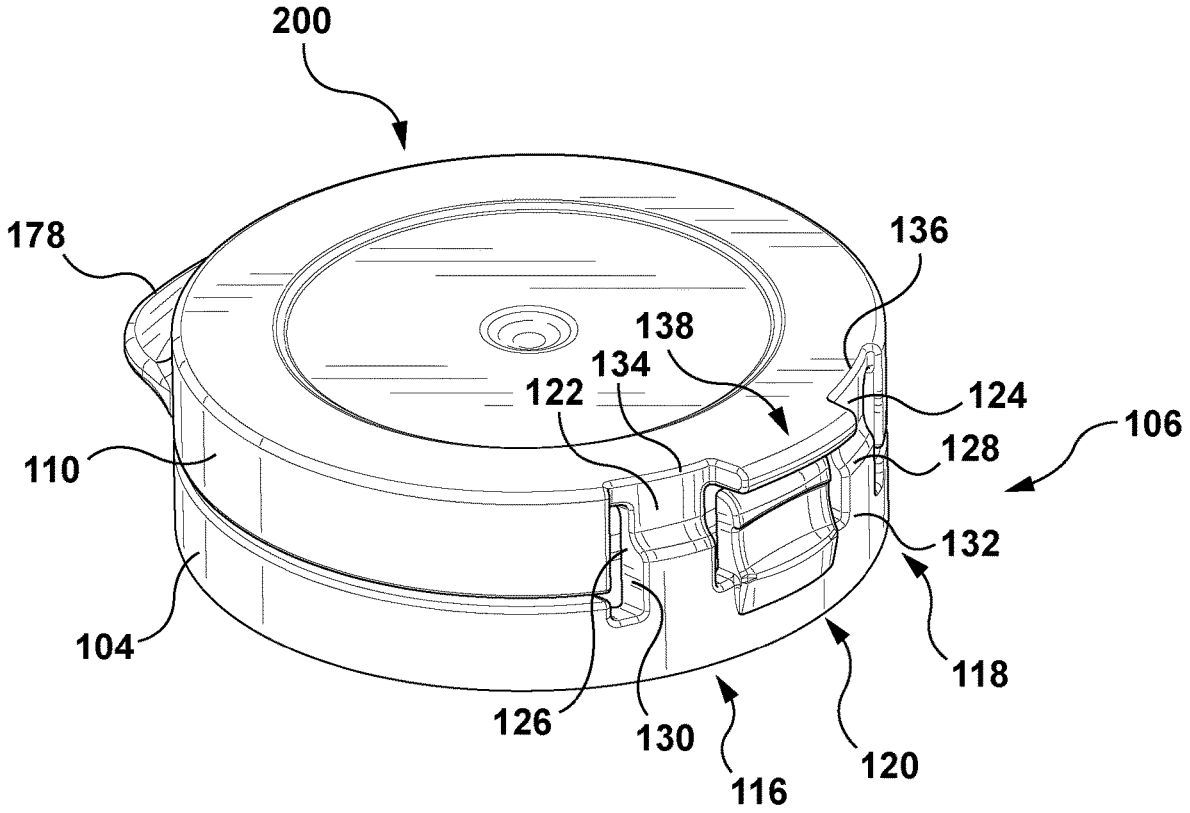
FIG. 4 depicts a perspective view from the above, oriented towards the back half of the closure cap shown in FIG. 1, which closure cap has a ratchet-like member with a body having an outer contour according to a second variant of the first embodiment of the outer contour.

FIG. 4 depicts the closure cap of FIGS. 1 and 2, while putting particular emphasis on the hinge region 106. The hinge elements 116, 118 depicted accordingly are identical to those depicted in FIG. 3 and discussed above under reference to that Figure.

Figure 7:
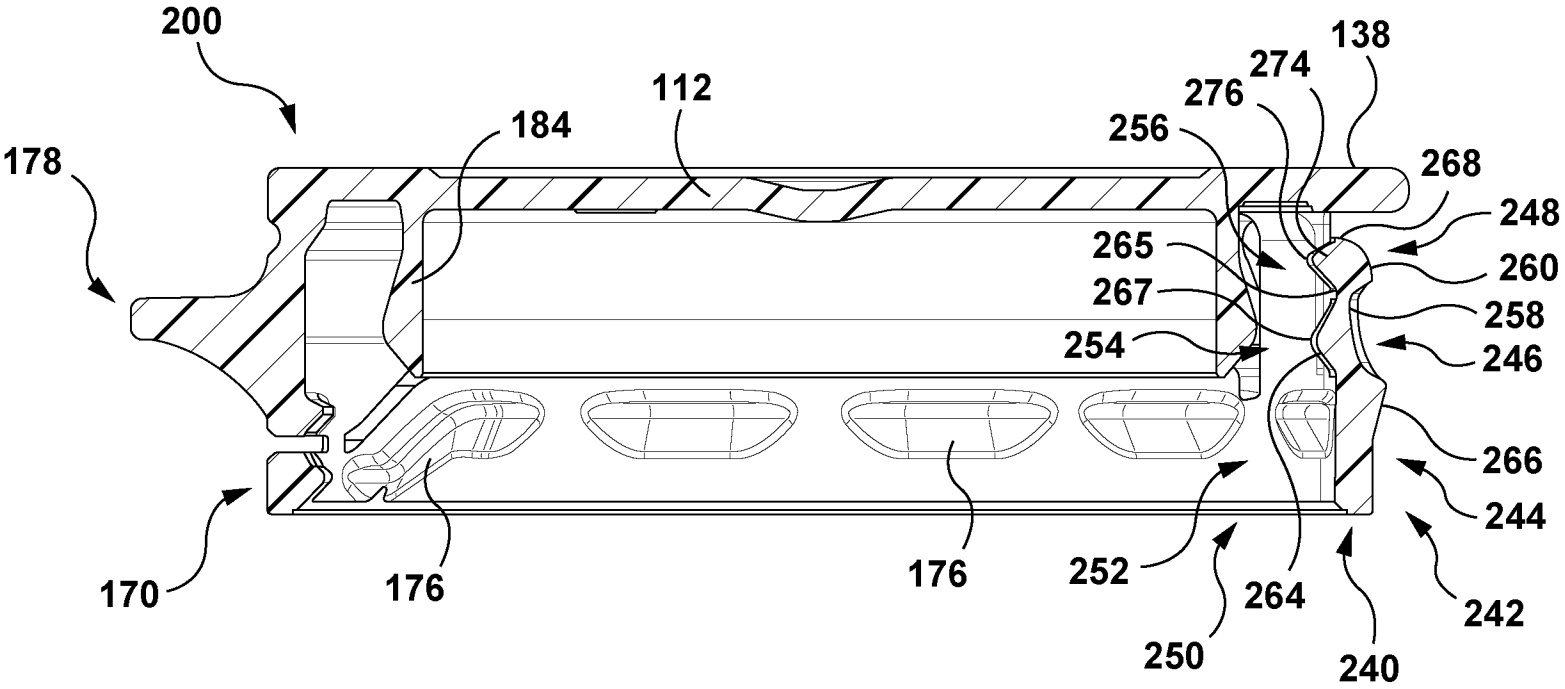
FIG. 7 depicts a sectional view of the closure cap shown in FIG. 4, which closure cap has a ratchet-like member having a body with an outer contour according to the second variant of the first embodiment of the outer contour, and an inner contour according to a second embodiment of the inner contour.

The ratchet-like member 120 employed in the closure cap 200 of FIG. 4, has a body 240 with an outer contour 242 profiled in accordance with a second variant of the first embodiment of the outer contour, and an inner counter 250 profiled in accordance with a second embodiment of the inner contour. The inner 250 and outer 242 contours of body 240 are depicted in FIG. 7 in more detail. Accordingly, one will appreciate the following. The lower portion 244 of the outer contour 242 of body 240 has a flat profile with an end section 266 sloping outwardly. The intermediate portion 246 of the outer contour 242 of body 240 has an inward curvature 258 with a concave profile. In comparison with the above-discussed first variant of a first embodiment of an outer contour 142 of body 140, i.e. the intermediate portion 146 of said contour 142 which has an inward curvature 158 with a substantially semi-circular profile (see FIGS. 6 and 9B to 9D), one will appreciate that the concave profile of the inward curvature 258 of the intermediate portion 246 of the presently discussed second variant of said first embodiment of an outer contour 242 of body 240 provides a smoother transition from the intermediate portion 246 of the outer contour 242 to the upper portion 248 thereof. The upper portion 248 of the outer contour 242 of body 240 has an outward curvature 260 which has a substantially semi-circular profile and an end section 268 having a nose-like profile. The lower portion 252 of the inner contour 250 of body 240 has a flat profile. The intermediate portion 254 of the inner contour 250 of body 240 has an outward curvature 264 with a convex profile having an apex 267 and a substantially flat end section 265. The upper portion 256 of the inner contour 250 of body 240 has an outward curvature 274 with a convex profile having an apex 276.

FIGS. 4 and 7 are supplemented by FIGS. 10A to 10D which illustrate on how lid 102 of closure cap 200, via hinge region 106 employing a ratchet-like member 120 having body 240 with the aforesaid outer 242 and inner 250 contours, is brought into and locked in a final open position of lid 102. In the depicted embodiment, the lid has an opening angle of about 210° (shown in FIGS. 10A and 10D). In order to also illustrated on how the intermediate portion 254 of the inner contour 250 of body 240 supports body 240 in the final open position of lid 102, the cross-sectional views of FIGS. 10B to 10D also depict part of a container neck.

Figure 10A:
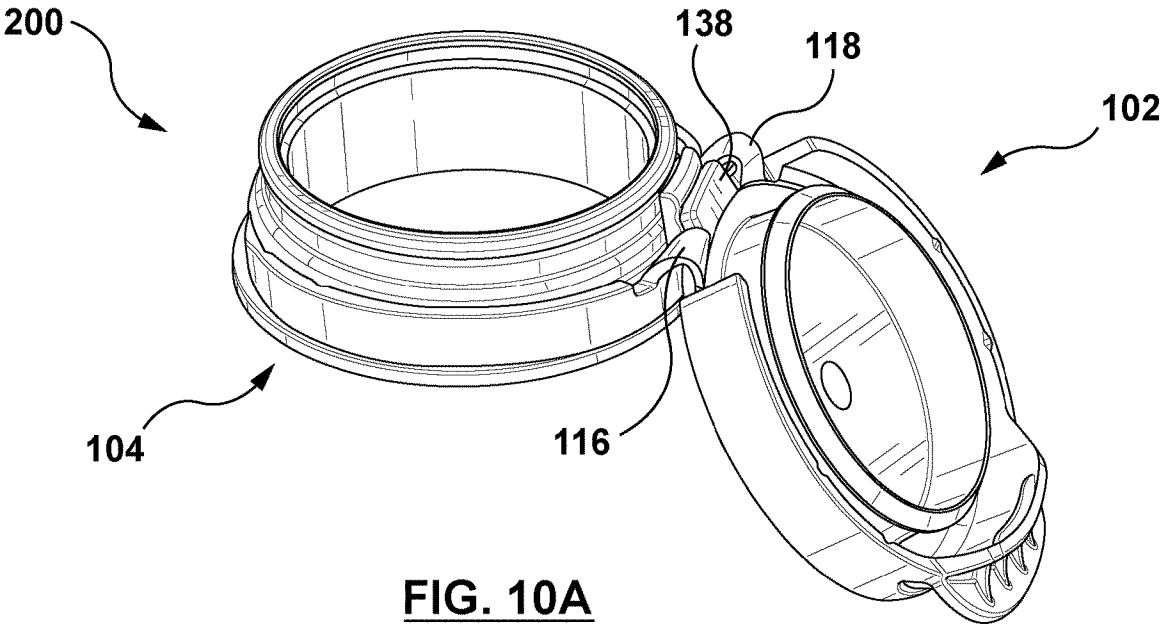
FIG. 10A depicts a perspective view of the closure cap shown in FIGS. 4 and 7 in its final open position, which closure cap has a ratchet-like member having a body with an outer contour according to the second variant of the first embodiment of the outer contour, and an inner contour according to the second embodiment of the inner contour.
Figure 10C:
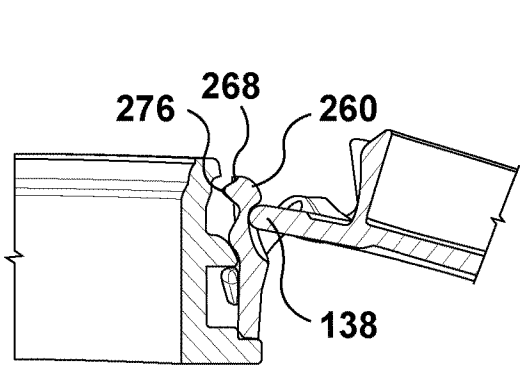
FIGS. 10B to 10D depict sectional views of the closure cap of FIG. 10A and show the lid in interaction with the hinge elements and the body of the ratchet-like member during opening of the lid and in its final open position.
Figure 10D:
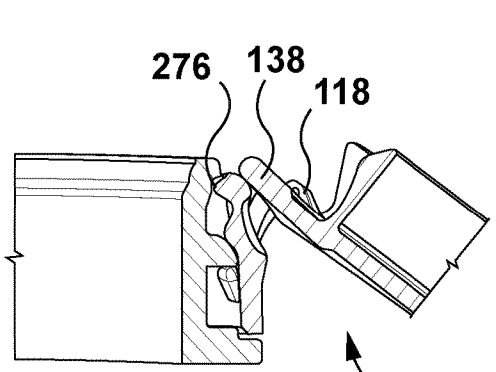
Figure 10B:
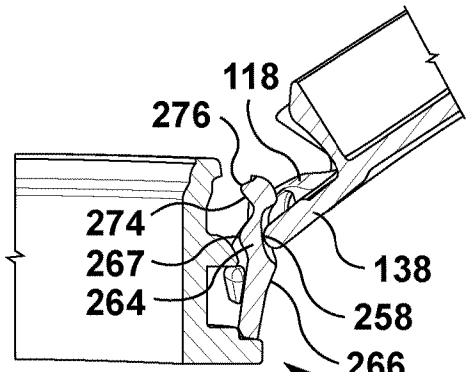

Under continued reference to FIG. 7, one will appreciate from FIGS. 10B to 10D the following.

From FIG. 10B, one will appreciate that the outwardly sloping end section 266 of the lower portion 244 of the outer contour 242 of body 240 ensures that during opening of the lid 102, an end portion of the tongue 138 formed in the top panel 108 of lid 102, is properly received by the concavely profiled inward curvature 258 of the intermediate portion 246 of the outer contour 242 of body 240. From FIGS. 10C and 10D one will appreciate that by way of the concave profile of the inward curvature of intermediate portion 246 of the outer contour 242 and the to semi-circular profile of the outward curvature 260 of the upper portion 248 of the outer contour 242, the and portion of the tongue 138 is smoothly guided towards an abutment of the outward curvature 260 of said upper portion 248, in which abutment the tongue 138 is firmly held in the final open position of lid 102 by virtue of the hinge elements 116 and 118. From FIG. 10D, showing the lid 102 in its final open position, one will appreciate that body 240 at this position of lid 102 is advantageously supported by the intermediate portion 254 of the inner contour 250 of body 240, namely in that the convex profiled outward curvature 264 of the intermediate portion 254 of the inner contour 250 abuts, in part, against a pilfer proof of a container neck. FIG. 10D further shows that the nose-like profiled end section 268 of the semi-circularly profiled outward curvature 260 of the upper portion 248 of the outer contour 242 as well as part of the convexly profiled outward curvature 274 of the upper portion 256 of the inner contour 250 each abut against part of an uppermost portion of a container neck finish. Although such an abutment provides further support for body 240, it however is not necessarily required for holding the lid 102 via tongue 138 in its final open position. Whether or not such an abutment occurs, rather depends on the design of the outer contour of the uppermost portion of a container neck finish and/or the plastic material used in the injection molding of a closure cap of the present invention.

Figure 5:
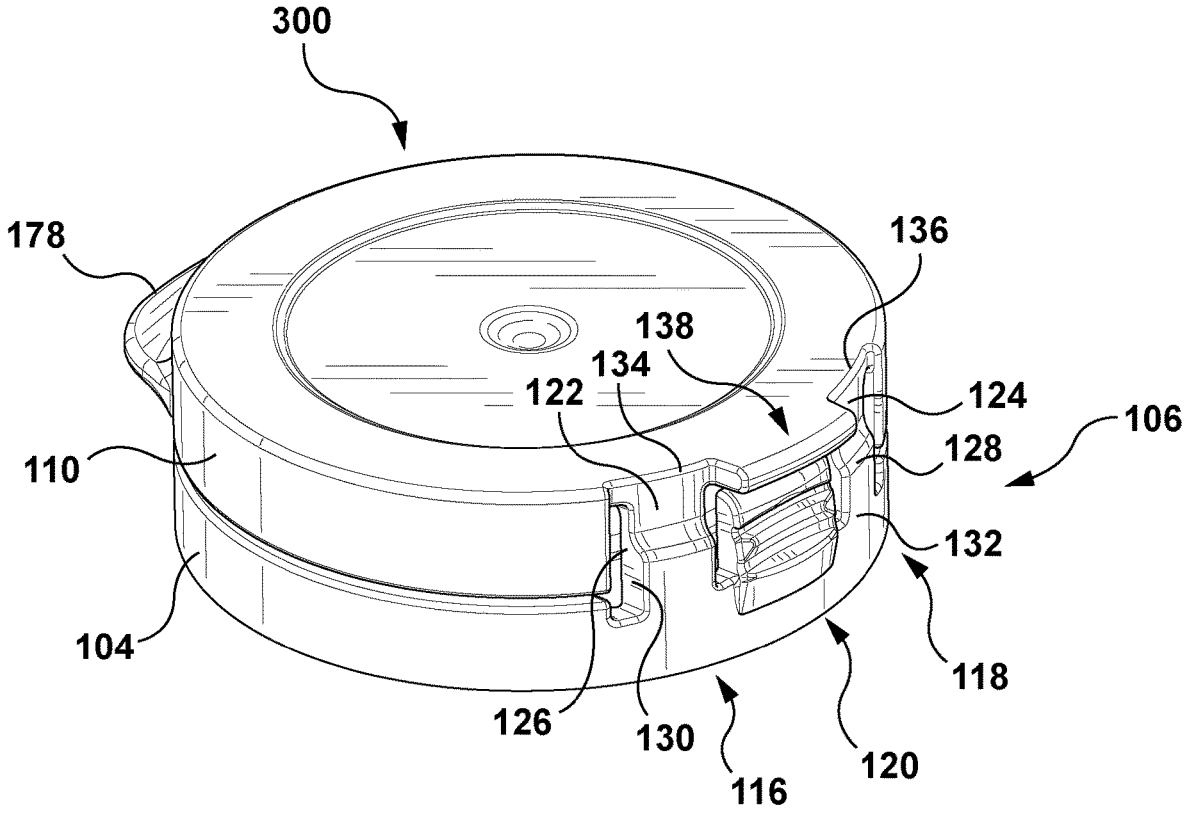
FIG. 5 depicts a perspective view from the above, oriented towards the back half of the closure cap shown in FIG. 1, which closure cap has a ratchet-like member with a body having an outer contour according to a second embodiment of the outer contour.

FIG. 5 depicts the closure cap of FIGS. 1 and 2, while putting particular emphasis on the hinge region 106. The hinge elements 116, 118 depicted accordingly, are identical to those depicted in FIG. 3 and discussed above under reference to that Figure.

Figure 8:
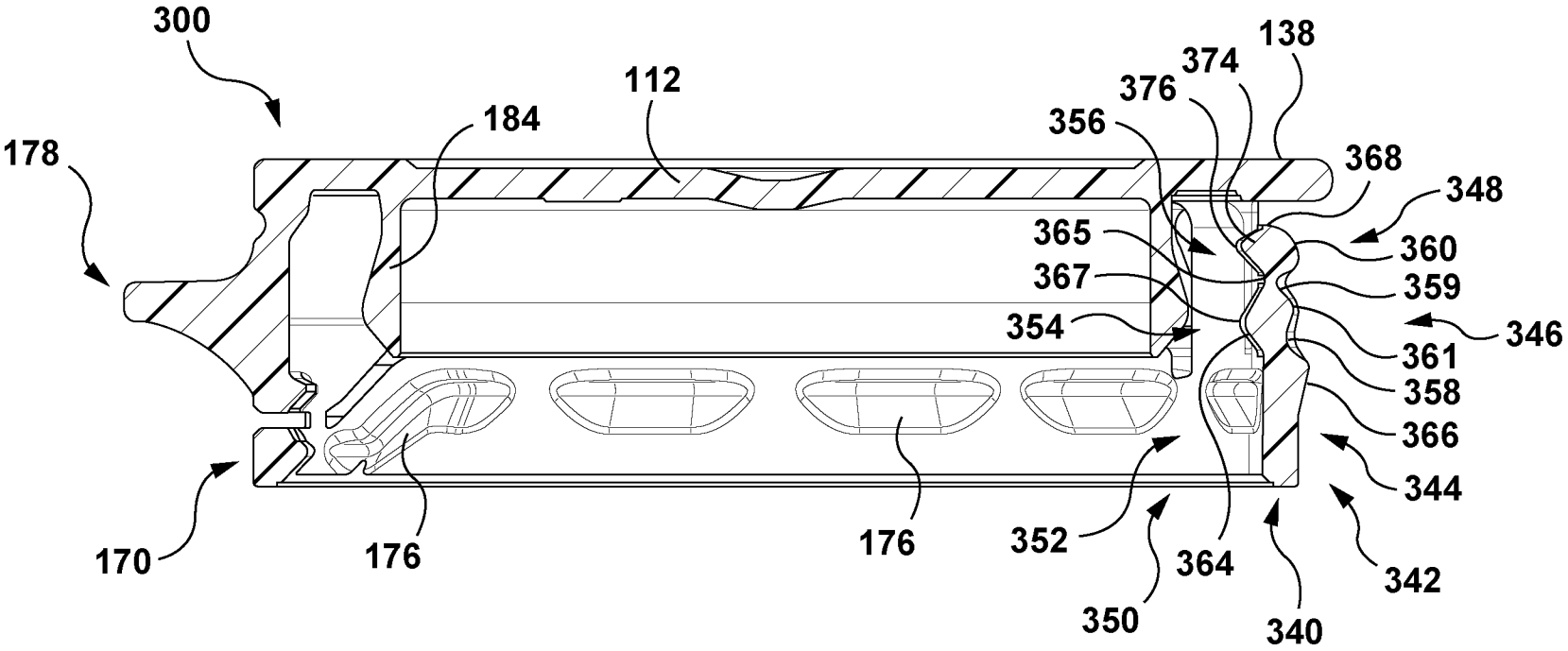
FIG. 8 depicts a sectional view of the closure cap shown in FIG. 5, which closure cap has a ratchet-like member having a body with an outer contour according to the second embodiment of the outer contour, and an inner contour according to the second embodiment of the inner contour.

The ratchet-like member 120 employed in the closure cap 300 of FIG. 5 has a body 340 with an outer contour 342 profiled in accordance with a second embodiment of an outer contour, and an inner counter 350 profiled in accordance with the aforesaid second embodiment of an inner counter. The inner counter 350 and the outer contour 342 are depicted in FIG. 8 in more detail. Accordingly, one will appreciate the following. The lower portion 344 of the outer counter 342 of body 340 has a flat profile with an end section 366 sloping outwardly. The intermediate portion 346 of the outer contour 342 of body 340 has a first inward curvature 358 having a substantially semi-circular profile, a second inward curvature 359 having a substantially semi-circular profile and an outward curvature 361 which is disposed between the first and second inward curvatures 358, 359 and has a substantially semi-circular profile. The upper portion 348 of the outer contour 342 of body 340 has an outward curvature 360 with a substantially semi-circular profile and an end section 368 having a nose-like profile.

As shown in FIGS. 11B to 11C, the second inward curvature 359 of the intermediate portion 346 of the outer contour 342 preferably has a smaller width than the first inward curvature 358 thereof, and the outward curvature 361 of the said intermediate portion 346 has a smaller width than the outward curvature 360 of the upper portion 348 of the outer contour 342 of body 340. The lower portion 352 of the inner contour 350 of body 340 has a flat profile. The intermediate portion 254 of the inner profile 350 of body 340 has an outward curvature 364 with a convex profile having an apex 367 and a substantially flat end section 365. The upper portion 356 of the inner profile 350 of body 340 has an outward curvature 374 with a convex profile having an apex 376.

FIGS. 5 and 8 are supplemented by FIGS. 11A to 11D which illustrate on how lid 102 of closure cap 102, via hinge region 106 employing a ratchet-like member 120 having body 340 with the aforesaid outer 342 and inner 350 contours, is brought into and locked in a final open position. In the depicted embodiment, lid 102 has an opening angle of about 210° C. (shown in FIGS. 11A and 11D). In order to also illustrate on how the intermediate portion 354 of the inner contour 250 of body 340 supports body 340 in the final open position of lid 102, the cross-sectional views of FIGS. 11B to 11D also depict part of a container neck.

Under continued reference to FIG. 8, one will appreciate from FIGS. 11B to 11D the following.

From FIG. 11B one will appreciate that the outwardly sloping end section 366 of the lower portion 344 of the outer contour 342 of body 340 ensures that during opening of the 102, an end portion of tongue 138 formed in the top panel 108 of lid 102, is properly received by the first inward curvature 358 of the intermediate portion 346 of the outer contour 342 of body 340. From FIGS. 11A and 11B one will appreciate that due to the aforesaid dimensions of the first and second inward curvatures 358, 359 of the intermediate portion 342, the outward curvature 361 disposed therebetween, and the outward curvature 360 of the upper portion 348 of outer contour 342, an end portion of the tongue 138 of lid 102 successively and gently is guided towards a position at which it from below abuts against the outward curvature 360 of the upper portion 348 of the outer contour 342 of body 340. At this position of tongue 138, the lid 102, by virtue of the hinge elements 116, 118 can be reliably held in an open position, i.e. an intermediate open position. In the depicted embodiment, the opening angle of lid 102 is in this intermediate open position greater than 210°.

FIG. 11D shows lid 102 in its final open position. In the illustrated embodiment, the opening angle is about 210°. Accordingly, one will appreciate from FIG. 11D that body 340 at this position of lid 102 is advantageously supported by the intermediate portion 354 of the inner contour 350 of body 340, namely in that the convexly profiled outward curvature 364 of the intermediate portion 354 of the inner contour 350 abuts, in part, against a pilfer proof of a container neck. FIG. 11D further shows that the nose-like profiled end section 368 of the semi-circularly profiled outward curvature 360 of the upper portion 348 of the outer contour 342 as well as part of the convexly profiled outward curvature 374 of the upper portion 356 of the inner contour 350 each abut against part of an uppermost portion of a container neck finish. Although such an abutment provides further support for body 340, it is however not necessarily required for holding lid 102 in its final open position. Whether or not such an abutment takes place, rather depends on the design of the outer contour of the uppermost portion of a container neck finish and/or the plastic material used in the injection molding of a closure cap of the present invention.

As illustrated in FIGS. 6, 7 and 8, respectively, for snugly fitting the closure cap 100, 200 and 300, respectively, onto a container neck, a plurality of cam-shaped stopper components 176, spaced apart from each other, is arranged along an inner circumference of the shell. In view of the aforesaid wall section 170 of reduced height of shell 104 (shown in FIG. 2), the plurality of stopper components 176 each having upper and lower surfaces, includes upper and lower sets of stopper components 176, such that the upper set is arranged at a first height of the inner surface of shell 104 and the lower set at a second height thereof, namely around the wall section 170 of reduced height. With the closure cap 100, 200 and 300, respectively, installed on a container neck, the upper surfaces of the supper set of stopper components 176 fit closely with respect to a lower surface of a pilfer proof of the container neck, whereas the stopper components 176 of the lower set are spaced well apart from the pilfer proof. With the attempt of opening the lid 102, the stopper components 176 of the lower set are deflected upwards, with elastic distortion of the shell's wall, wherein the upper surfaces of said stopper components 176 also engage with the lower surface of the pilfer proof of the container neck to further retain the shell 104 on the container neck.

In order to stiffen the wall section 170 of reduced height of the shell 102, adjacent to each cutline of the inverted trapezoid cut-out 172 (shown in FIG. 2), a cam-shaped stopper component 176 preferably is such designed that it comprises a body portion that has an inclination similar to that of the inclined cut lines.

From FIGS. 6, 7 and 8, respectively, one will further appreciate that the bottom face 112 of the top panel 108 of the lid 102 further comprises a plug seal 184 which is integrally formed therewith and is configured to sealingly fit into a neck finish of a container neck.

It is noted that the foregoing has outlined some of more pertinent non-limiting embodiments. It will be clear to those skilled in the art that modifications to the disclosed non-limiting embodiments can be effected without departing from the spirit and scope thereof. As such, the described non-limiting embodiments ought to be considered to be merely illustrative of some of the mere prominent features and applications.

What is claimed is:

1. A closure cap for a container comprising:

a lid and a shell, and a hinge region for pivotally connecting the lid and for locking the lid in an open position thereof;

the lid comprising a top panel having a tongue adjacent the hinge region and a wall suspended from a bottom face of the top panel and connected to the shell via a plurality of bridges configured to break upon a first opening of the lid, the hinge region comprising a pair of elongate hinge elements spaced apart from each other, and a ratchet-like member disposed therebetween, the hinge elements being integrally formed with the shell and the top panel, and each having a lower portion and an intermediate portion having an inwardly sloping outer face, thereby providing an upper portion having, relative to a wall thickness of the lower portion, a wall of reduced thickness;

the ratchet-like member being integrally formed with the shell and having a body with an outer contour comprising a lower, an intermediate and an upper portion, and an inner contour comprising a lower, an intermediate and an upper portion, wherein the intermediate portion of the outer contour comprises at least one inward curvature for guiding an end portion of the tongue during opening of the lid, and the upper portion of the outer contour comprises an outward curvature for providing an abutment for the end portion of the tongue in a final open position of the lid.

2. The closure cap according to claim 1, wherein the wall thickness of the lower portions of the hinge elements corresponds to a wall thickness of the shell.

3. The closure cap according to claim 1, wherein the upper portions of the hinge elements each provide a recess in the top panel of the lid, which recesses in concert form the tongue of the top panel.

4. The closure cap according to claim 1, wherein the intermediate portion of the inner contour of the body comprises a profile configured to provide, at least in part, an abutment with respect to a pilfer proof of a container neck in the final open position of the lid.

5. The closure cap according to claim 1, wherein part of the upper portion of the inner contour of the body comprises a profile configured to abut, at least in part, against a portion of a container neck finish in the final open position of the lid.

6. The closure cap according to claim 1, wherein the lower portion of the outer contour of the body has a flat profile sloping outwardly at an upper end section thereof, the inward curvature of the intermediate portion of the outer contour of the body either has a substantially semi-circular profile or has a concave profile, and the outward curvature of the upper portion of the outer contour has a substantially semi-circular profile with an end section having a nose-like profile.

7. The closure cap according to claim 1, wherein the lower portion of the outer contour of the body has a flat profile sloping outwardly at an upper end section thereof, the intermediate portion of the outer contour of the body comprises a first inward curvature, a second inward curvature and an outward curvature disposed therebetween, and the outward curvature of the upper portion of the outer contour of the body has an end section having a nose-like profile.

8. The closure cap according to claim 7, wherein the second inward curvature of the intermediate portion of the outer contour is configured to hold, in concert with part of the outward curvature of the upper portion of the outer contour, an end portion of the tongue in an intermediate open position of the lid.

9. The closure cap according to claim 7, wherein the first inward curvature of the intermediate portion of the outer contour has a substantially semi-circular profile, the second inward curvature thereof has a substantially semi-circular profile, and the outward curvature disposed between said first and second inward curvatures has a substantially semi-circular profile, wherein a width of the second inward curvature is less than a width of the first inward curvature, and wherein the outward curvature of the upper portion of the outer contour has a substantially semi-circular profile having a width greater than a width of the outward curvature of the intermediate portion of the outer contour.

10. The closure cap according to claim 6, wherein the lower portion of the inner contour of the body has a flat profile, the intermediate portion of the inner contour of the body has an inward curvature configured to abut, at least in part, against a pilfer proof of a container neck in the final open position of the lid, and the upper portion of the inner contour of the body has a flat profile.

11. The closure cap of claim 7, wherein the inward curvature of the intermediate portion of the inner contour has a concave profile.

12. The closure cap according to claim 6, wherein the lower portion of the inner contour of the body has a flat profile, the intermediate portion of the inner contour of the body has an outward curvature and an end section with a substantially flat profile, the outward curvature being such positioned that it, at least in part, abuts against a pilfer proof of a container neck in the final open position of the lid, and the upper portion of the inner contour of the body has an outward curvature.

13. The closure cap according to claim 12, wherein the outward curvature of the intermediate portion of the inner contour has a convex profile forming an apex, and wherein the outward curvature of the upper portion of the inner contour has a convex profile forming an apex.

14. The closure cap of claim 1, wherein on a side of the closure cap opposite to the hinge region, the shell has a wall section of reduced height provided by an inverted trapezoid cut-out having identically inclined cut lines, and wherein in a closed position of the lid, the wall section accommodates a complementarily shaped wall section of the wall of the top panel of the lid.

15. The closure cap according to claim 14, wherein the shell, along an inner circumference thereof, comprises a plurality of cam-like stopper components spaced apart from each other and configured to slide over a pilfer proof of a container neck during capping of the closure cap, and wherein in a region of the shell adjacent to each of the inclined cut lines of the trapezoid cut-out, a cam-like stopper component is provided having a body portion with an inclination similar to that of the cut lines.

16. The closure cap according to claim 15, wherein the closure cap in a closed position of the lid defines a back half which includes the hinge region and a front half which comprises the plurality of bridges, wherein the bridges each are positioned above a space defined by two adjacent cam-like stopper components.

17. The closure cap according to claim 15, wherein the complementarily shaped wall section of the wall of the top panel of the lid carries a tongue-like projection configured to be gripped by a user for opening the lid.

18. The closure cap according to claim 17, wherein the tongue-like projection is integrally formed with the wall section of reduced height of the wall of the top panel and has an arc-shaped support structure.

19. The closure cap according to claim 1, wherein the bottom face of the top panel comprises a plug seal configured to sealingly fit into a neck finish of a container neck.

* * * * *